United States Patent [19]

Ohkita et al.

[11] 4,129,764

[45] Dec. 12, 1978

[54] PUSH SWITCH

[75] Inventors: Masao Ohkita; Hidetoshi Sato, both of Furukawa, Japan

[73] Assignee: Alps Electric Co., Ltd., Japan

[21] Appl. No.: 815,715

[22] Filed: Jul. 14, 1977

[30] Foreign Application Priority Data

Jul. 15, 1976 [JP] Japan ..... 51-94285

[51] Int. Cl.[2] ..... H01H 13/52

[52] U.S. Cl. ..... 200/159 R; 200/64; 200/153 LA; 200/156; 200/328; 200/DIG. 25

[58] Field of Search ..... 200/64, 77, 67 G, 67 AA, 200/153 N, 156, 159 R, 159 A, 328, DIG. 25, 67 DA, 68, 153 LA

[56] References Cited

U.S. PATENT DOCUMENTS 936,601 10/1909 Carson ..... 200/64 X 1,489,189 4/1924 Noditsch ..... 200/64

2,577,362 12/1951 Popp ..... 200/64

*Primary Examiner*—William Price

*Assistant Examiner*—Joseph Man-Fu Moy

*Attorney, Agent, or Firm*—Guy W. Shoup; Gerard F. Dunne

[57] ABSTRACT

A push switch is adapted for use in combination with a variable resistance. The switch comprises an insulating driving body rotatably mounted on a slider which is adapted to be moved by a push rod or shaft, and at least two metal pieces carrying electrical contacts. These members are positioned within a casing in such a manner that the movement of the slider causes the driving body to be rotated by contact with a projection formed on one of the metal pieces. The rotation of the driving body causes electrical contacts to move to and from each other.

12 Claims, 20 Drawing Figures

Fig. 3
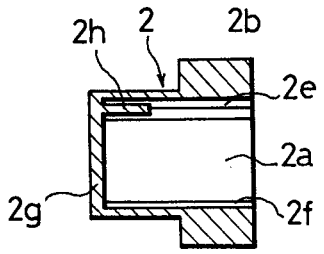
Fig. 4A
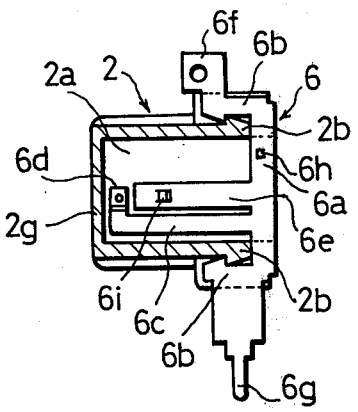
Fig. 4B
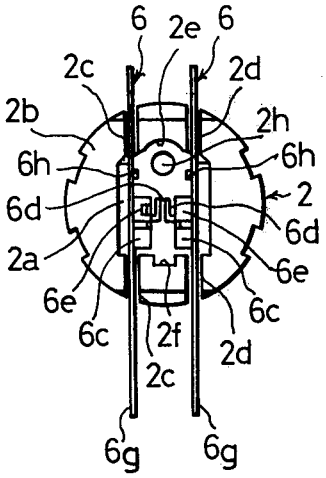
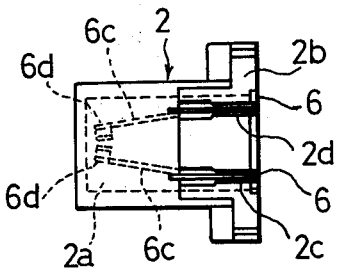
Fig. 4C

PUSH SWITCH

BACKGROUND OF THE INVENTION

The present invention relates to a push-pull switch adapted for use mainly in combination with a rotatable variable resistance.

The field of push-pull electrical switches may be considered to be a crowded and well-developed technical field in which improvements are in the exact manner and elements of construction. There have been hundreds of push-pull switches of various constructions which have been suggested and many examples of such constructions are presently being commercially marketed.

The object of the invention is to provide a push-pull switch which comprises a lesser number of parts, which is easy to assemble and which will not be likely to malfunction with prolonged usage.

The above and the other objects, as well as advantageous features of the invention, will become clear from the following description of a preferred embodiment taken in conjunction with the attached drawings in which:

BRIEF DESCRIPTION OF THE DRAWINGS

FIG. 3 is a side elevational sectional view of a casing for the switch section, FIG. 4A is a side elevational sectional view of an essential part of the switch section, FIG. 4B is a front elevation of the essential part of the switch section, FIG. 4C is a top plan view of the essential part of the switch section.

DESCRIPTION OF THE PREFERRED EMBODIMENTS.

Figure 1:
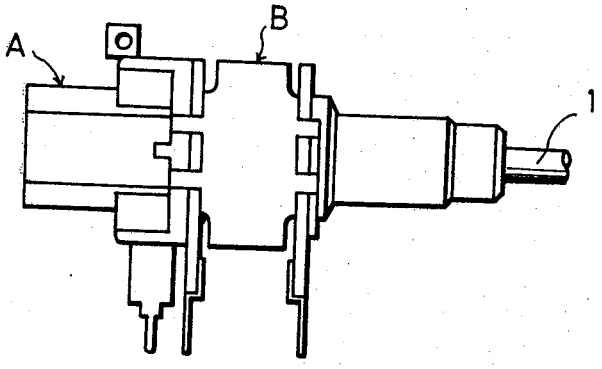
FIG. 1 is a side elevational view of a switch according to the present invention which is also a rotary variable resistor.

Referring to the drawings showing an embodiment of the present invention, and first referring to FIG. 1, a switch-equipped variable resistance consists of a switching section A and a variable resistance section B. The changing-over or the switching of the switching section A is performed by pushing and pulling an operation shaft 1, while the resistance value of the variable resistance section B is varied by rotating the same operation shaft 1.

Figure 2:
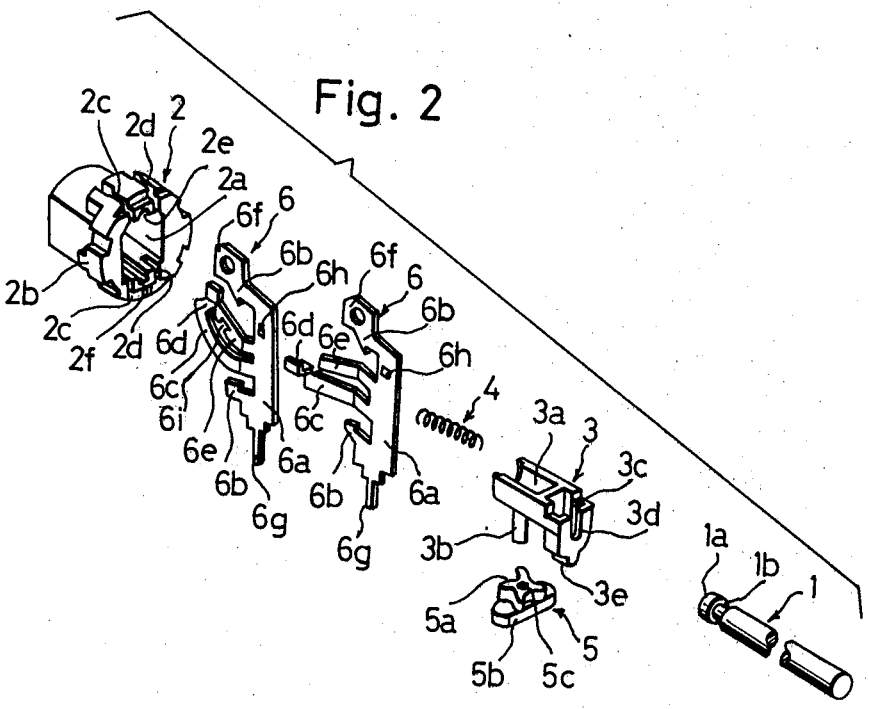
FIG. 2 is an exploded perspective view of a switch section, showing the push-pull switch elements.

The switch section A will be explained in detail with specific reference to FIG. 2 which shows an exploded perspective view. Switch section A includes a casing 2 made of a plastic resin and has a central hollow section 2*a*. The peripheral edge 2*b* of the case 2 is provided with four slits 2*c*, 2*c* and 2*d*, 2*d*. A semi-cylindrical recess 2*e* and a groove 2*f* are formed in the inner wall surface of the case 2, at the upper and lower portion of the latter as viewed in the drawings, respectively. These recess and groove have sufficient lengths to reach the bottom 2*g* (FIG. 3) of the case 2. A projection 2*h* is formed unitarily with the case 2 to stand up from the bottom 2*g*.

A slider 3 of a formed plastic resin is provided at its upper surface with a semi-cylindrical recess 3*a* for receiving a coil metal spring 4, and at its lower surface, with a driving pin 3*b* formed thereon.

On the side surface of the slider 3, a container section 3*c* having a notch 3*d* for receiving a head 1*a* of the operation shaft 1 is provided. The shaft 1 may freely rotate within the notch 3*d* and will push or pull the slider 3 when the shaft 1 is moved along its axis. In the lower surface of the container section 3*c*, there is formed a projection 3*e* adapted for sliding in the groove 2*f* of the casing 2.

A driving body 5 is made of a plastic resin insulating material and has a cam-teeth section 5*a* and a rectangular driving section 5*b*. The driving body 5 is freely rotatably supported on the slider 3 by a pin 3*b* of the slider which passes through a central bore 5*c* of the driving body 5. The aforesaid plastic resin members may be injection molded of a suitable plastic resin, such as a suitable nylon, polycarbonate, ABS or other resin.

The generally E-shaped resilient metallic plates 6,6 have supporting sections 6*a*,6*a* on which retaining pieces 6*b*,6*b* and 6*b*,6*b* are arranged in pairs in the vertical direction. The metallic plates 6,6 are further provided with, at their central portion, contact pieces 6*c*,6*c* associated with the driving section 5*b* of the driving body 5, as well as driving pieces 6*e*,6*e* adapted to resiliently engage the cam-teeth section 5*a*. The plates are formed, for example, stamped from sheet metal, and are resilient flexible electrically conductive members. Alternatively, and not shown, the contact pieces 6*c*,6*c* may be separate members.

The ends of the contact pieces 6*c*,6*c* are bent to form contacts 6*d*,6*d* while portions 6*f*,6*f* and 6*g*,6*g* constitute terminals.

Claws 6*h*,6*h* are provided corresponding to the supporting section 6*a*,6*a*, while a projection 6*i* is formed on the driving piece 6*e* of both of the metal pieces 6,6.

One way to assemble the switch section A is as follows: At first the coiled spring 4 is inserted into the hollow section 2*a* of the casing 2, and is attached onto the projection 2*h*.

Subsequently, the slider 3 with its driving pin 3*b* rotatably carrying the driving body 5 is brought into the hollow section 2*a* of the casing 2.

At this time, the end of the pin 3*b* and a projection 3*e* of the slider 3 are received by the groove 2*f* of the casing 2. At the same time, the coiled spring 4 is received by the semi-cylindrical recess of 3*a* of the slider 3.

Subsequently, as detailed in FIGS. 4A to 4C showing the essential parts, the contact pieces 6*c*,6*c* and the driving pieces 6*e*,6*e* of the two metal pieces 6,6 are disposed in the hollow section 2*a* of the casing 2, as the upper and the lower retaining pieces 6*b*,6*b* of one of the metal pieces 6 is fitted into the slits 2*c*,2*c* in the peripheral edge 2*b* of the casing 2, while the retaining pieces 6*b*,6*b* of the other metal piece 6 are fitted into the slits 2*d*,2*d*.

In this state, the ends of the retaining pieces 6*b*,6*b* are retained by a part of the peripheral edge 2*b* of the casing 2, so as to prevent the metal piece 6 from being dropped out.

At the same time, the claws 6*h*,6*h* on the supporting sections 6*a*,6*a* of the metal pieces 6,6 abut the side surface of the slider 3, to maintain the latter 3 in an energized state by the coiled spring 4 within the hollow section 2a of the casing 2.

At the same time, the contacts 6d,6d of the contact pieces 6c,6c of the metal pieces 6,6 are adapted to contact with each other by their own resiliency. (See FIG. 4A).

In addition, the driving pieces 6e,6e of the metal pieces 6,6 are adapted to be resiliently pressed onto and clamp the cam-teeth section of the driving body which has been previously housed by the hollow section 2a, while the projection 6i of the one of the driving piece 6e comes to engage with the cam-teeth section 5a.

Finally, the reduced-diameter section 1b of the operation shaft 1 is fitted into the notch 3d provided at the container section 3c of the slider 3, so as to bring the head 1a of the operation shaft 1 into the container section 3c to complete the switch section A.

The switch section A may, alternatively, be assembled in another way than described above. This alternative assembly method is as follows:

Namely, at first two metal pieces 6,6 are fitted into the slits 2c,2c and 2d,2d of the casing 2. Subsequently, the coiled spring 4 is secured to the projection 2h on the bottom 2g of the casing 2. Then, the slider 3 having the driving body 5 is put in the hollow section 2a of the casing 2a. At this time, the slider 3 comes to abut the claws 6h,6h of the metal pieces 6,6. However, the resiliency of the metal pieces 6,6 allows snapping of the slider 3 into the hollow section 2a. Thus, the claws 6h,6h come to be retained at side surfaces of the slider 3, thereby to maintain the slider 3 in the hollow section 2a of the casing 2. Finally, the head of the operation shaft 1 is put into the container section 3c of the slider 3, to complete the switch section A.

Figure 5:
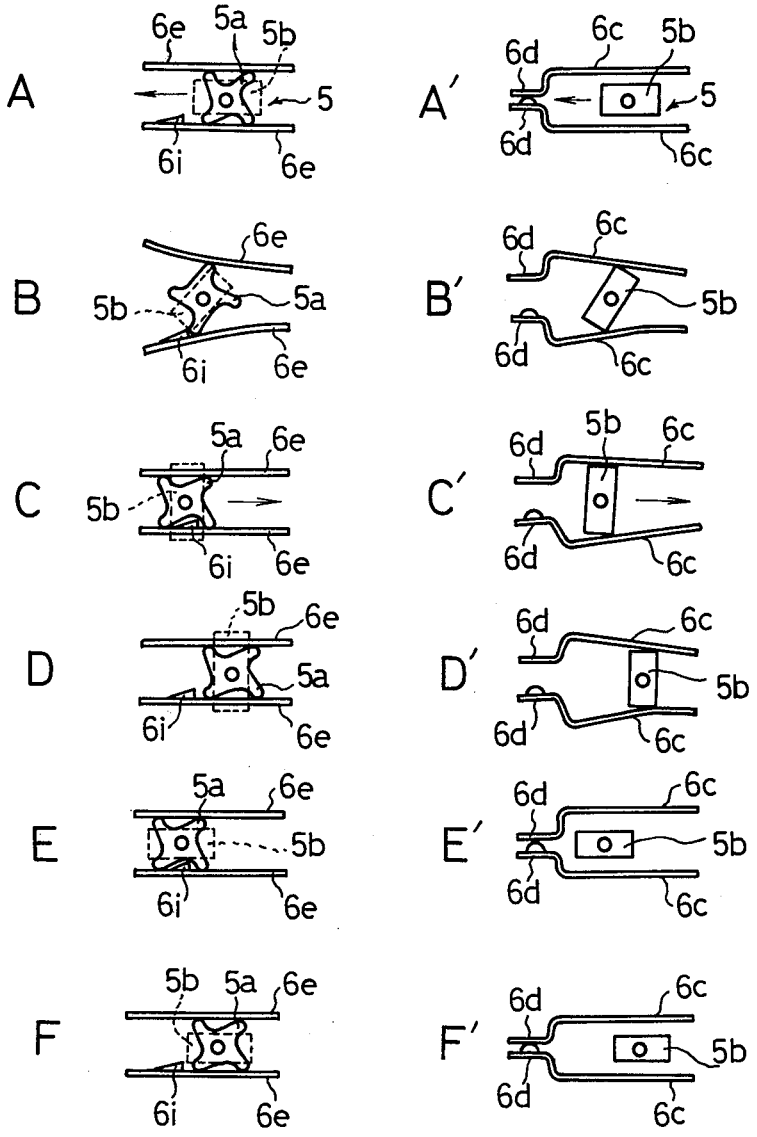
FIGS. 5A to 5F are illustrations explanatory of the manner of operation of cam teeth section and a driving piece, and FIGS. 5A' to 5F' are illustrations explaining the operation of a driving section and a contact piece.

Referring now to FIG. 5 showing the manner of operation of the switch section, at first the switch is kept at its ON state, with the contacts 6d,6d of the contact pieces 6c,6c on the metal pieces 6,6 abut with each other, as shown in FIG. 5A.

When the operation shaft 1 is depressed (pushed inwardly) the head 1a of the shaft moves the slider 3 along the groove 2f in the inner wall of the casing 2, against the biasing force of the coil spring 4.

Concurrently, the driving body 5 rotatably secured to the slider 3 through a driving pin 3b is moved in the direction of arrows in FIGS. 5A and 5A'. Then, the cam-teethed section 5a of the driving body 5 having been clamped by the driving pieces 6e,6e of the metal pieces 6,6 comes in engagement with the projection 6i on one of the driving piece 6e to be rotated, as will be seen from FIGS. 5B,5B', so that the rectangular driving section 5b unitary with the cam-teethed 5a is brought perpendicular to the contact pieces 6c,6c as shown in FIG. 5C', to move the later 6c,6c apart from each other to release the contacts from each other.

As the depressing force is released, the coiled spring 4 received by the semi-cylindrical recess 2e of the slider 3 urges the slider 3 to its original position. The driving body 5 on the driving pin 3b of the slider 3 moves in the direction of arrow of FIGS. 5C,5C', so that the cam-teeth section 5a slides along the inclined surface of the projection 6i of the one 6e of the driving pieces without rotating, so that the driving piece 5b is kept perpendicular to the contact pieces 6c,6c as shown in FIGS. 5D,5D', to keep the contact pieces 6c,6c away from each other, i.e. at the OFF status of the switch.

A subsequent depression of the operation shaft 1 repeats the described operation and the cam-teeth section 5a of the driving body 5 is rotated by the projection 6i, as shown in FIGS. 6E,6E, so as to bring the driving section 5b in parallel with the contact pieces 6c,6c, to allow the contacts 6d,6d of the contact pieces 6c,6c to engage with each other to turn the switch to ON.

As the depressing force is released, the driving body 5 is returned to its original position, without being rotated, i.e. with its driving section 5b kept in parallel with the contact pieces 6c,6c, preserving the ON status of the switch.

The rectangular driving body 5 is so dimensioned that its one side is longer than the distance between the contact pieces 6c,6c, while the other side is shorter.

As has been described, the switching of the switch section A can be completed by pushing and pulling the operation shaft 1.

To sum up, according to the invention, a push switch is provided with an insulating driving body 5 having a cam-teeth section 5a and a driving section 5b and rotatably secured to a slider 3. The casing has a hollow section 2a for movably accomodating the driving body and the slider 3, and at least two resilient metal pieces 6,6 having contact pieces 6c and driving pieces 6e. The metal pieces 6,6 are attached to the casing 2, and the contact pieces 6c and the driving pieces 6e disposed in the hollow section with the driving pieces 6e,6e clamping the cam-teeth section 5a therebetween. The driving pieces 6e,6e and the contact pieces 6c,6c may each be separate members. In other words, the driving pieces 6e,6e may each be completely separate members. A projection 6i is provided on one of the driving pieces 6e for engagement with the cam-teethed section 5a, whereby the driving body is rotated by the movement of the slider 3, through the projection 6i, to allow both contact pieces 6c,6c to contact with each other.

The switching operation of the switch can be performed without fail by the movement of the slider 3, through the depression of the operation shaft 1.

The switch can be easily assembled by simple insertion and snapping of parts into the casing 2, thus providing a compact push switch having a lessened number of parts and which is easy to assemble.

What is claimed is:

1. A push switch comprising an insulating driving body having a cam-teeth section and a driving section, a slider to which said driving body is rotatably secured, a casing having a hollow section for movably accomodating said driving body and said slider, at least two metal members each having a contact piece and which are disposed in said hollow section of said casing, and at least two driving pieces which are also disposed in said hollow section of said casing, said driving pieces clamping said cam-teeth section therebetween, a projection provided on one of said driving pieces for engagement with said cam-teeth section, said driving body being rotated by the movement of said slider and engagement of a cam-teeth by said projection, said driving body rotation moving said contact pieces into and out of contact with each other.

2. A push switch as in claim 1, wherein said cam-teeth section has four cam teeth.

3. A push switch as in claim 1, wherein said driving section is an elongated generally rectangular section.

4. A push switch as in claim 1, wherein said slider has a rod portion upon which said driving body is rotatably secured.

5. A push switch as in claim 1, wherein said casing has a groove and said slider has a projection which slides within said groove.

6. A push switch as in claim 1 and further including an operating shaft held in one end of said slider.

7. A push switch as in claim 1 and further including a spring means to bias said slider away from movement into said hollow section.

8. A push switch as in claim 7, wherein said casing has an internal projection and said spring means is a coil spring mounted on said projection.

9. A push switch as in claim 1 and further including an operation shaft which is rotatably mounted in one end of said slider to push and pull said slider, an adjustable resistor fixed to said casing and having a rotatable slide, the slide of said resistor being fixed to said operation shaft for rotation along with the rotation of said shaft.

10. A push switch as in claim 1 wherein each metal member and each driving piece are joined in a unitary metal member so that said switch has two of the said unitary metal members.

11. A push switch as in claim 1 wherein at least one of said driving pieces is a resilient flexible metal spring member.

12. A push switch as in claim 1 wherein both of said driving pieces are resilient flexible metal spring members.

* * * * *